United States Patent [19]

Jukes

[11] Patent Number: 4,477,980

[45] Date of Patent: Oct. 23, 1984

[54] ALIGNMENT STRUT FOR WALL STRUCTURES

[75] Inventor: Christopher E. Jukes, Vancouver, Canada

[73] Assignee: Mod-Lok Industries Ltd., Vancouver, Canada

[21] Appl. No.: 492,170

[22] Filed: May 6, 1983

[51] Int. Cl.[3] ..... G01C 15/10

[52] U.S. Cl. ..... 33/404; 33/180 R; 33/286; 33/408; 52/127.2

[58] Field of Search ..... 33/404, 405, 407, 408, 33/180 R, 286, 201; 52/127.1, 127.2, 127.5, 127.6

[56] References Cited

U.S. PATENT DOCUMENTS 2,491,638 12/1949 Ayers ..... 33/404

2,679,745 6/1954 Bartram ..... 33/408

2,801,818 8/1957 Wojoyla ..... 33/404

4,089,141 5/1978 Heroux ..... 52/127.2

FOREIGN PATENT DOCUMENTS 816149 7/1949 Fed. Rep. of Germany ..... 33/404

*Primary Examiner*—Willis Little

*Attorney, Agent, or Firm*—Harlan P. Huebner

[57] ABSTRACT

An alignment strut for use in constructing prefabricated walls comprises a reusable sheet metal strut having an interior pocket accommodating a lumber two by four which serves as a splice bar between adjacent struts and as a brace anchor point. Each strut is provided with means for suspending it on the upper edge of the marginal plates of a prefabricated wall structure and bears against such plates below their upper margins.

3 Claims, 4 Drawing Figures

ALIGNMENT STRUT FOR WALL STRUCTURES

BACKGROUND OF THE INVENTION

1. Field of the Invention

The present invention relates to wall construction of the type in which concrete is poured between outside side plates and inner insulating panels held spaced apart by spacing strips, and more particularly to an alignment strut for retaining adjacent side plates in position during fabrication of the wall structure.

2. Description of the Prior Art

In the use of prefabricated assemblies for forming concrete wall structures, such as those described in Nilsen et al. U.S. Pat. No. 4,149,349 and the prior art identified therein, it has been the practice to employ bracing systems for maintaining the prefabricated assemblies in position during the pouring and setting of the concrete within the assembly.

Heretofore, before pouring the concrete into a prefabricated wall, a series of "ladders" were made which consisted of parallel lines of lumber two by fours held apart by wooden struts nailed to the top edges of the two by fours. These ladders, when fabricated, were placed on top of the prefabricated wall structure and braced from one side or the other to either stakes in the ground or to adjacent scaffolding. These ladders were not only costly in both labor and material to produce, but had to be lifted up into place on the prefabricated wall structure; a particularly difficult task if reinforcing steel was projecting vertically out of the prefabricated wall structure. Additionally, the struts between the parallel two by fours would often accidentally impinge on vertical tabs projecting from the prefabricated wall panel, bending them down and making the installation of the next row of panels difficult. Then when introducing concrete into the wall structure, a task usually accomplished by flowing it out of a hose, the steam would accidentally impinge on the struts of the ladder and splatter over the side of the prefabricated wall structure, not only wasting concrete, but also making the clean up more difficult. Finally, the ladders being made out of lumber were not always true and straight, requiring the exercise of care to insure that even though the struts were aligned, they were true and straight.

It is the primary object of the present invention to provide a reusable alignment strut which will perform all of the functions of the ladder structures described above, but will have none of their undesirable features. Additionally, it is an object of the present invention to provide an alignment strut having additional desirable features not found in the prior art.

SUMMARY OF THE INVENTION

According to the present invention, alignment struts are fabricated from sheet metal of sufficient rigidity to hold its shape, which is that of a generally U-shaped beam structure having upper and lower parallel legs. The upper of the legs, which is longer than the lower leg, has its free end formed as a downwardly extending flange which is adapted to engage over the upper edges of the plates constituting one margin of the prefabricated wall structure and, where plates are employed which have upwardly projecting tabs, the upper leg is provided with apertures positioned to accommodate them. The lower and shorter of the legs is engageable with the side surface of the plates forming one margin of the prefabricated wall structure, so that a pocket is provided between the legs into which a splice bar may be introduced in order to connect adjacent ones of such struts; the splice bar being adapted to be wedged against the plate in order to form a stable structural assembly. This splice bar which may conveniently be made in the form of a lumber two by four also provides a nailing area onto which bracing can be readily attached.

The alignment struts of the present invention are designed to be hung in the manner described one on either of the sides of the prefabricated wall structure without risk of damage to any vertically extending alignment tabs on the plates and without risk of deflection of fluid concrete by any cross-over connections between the struts.

After the pouring and setting of the concrete in the interior of the wall structure, the alignment struts of the present invention are intended to be removed and repeatedly reused.

DETAILED DESCRIPTION OF THE PREFERRED EMBODIMENT

Figure 1:
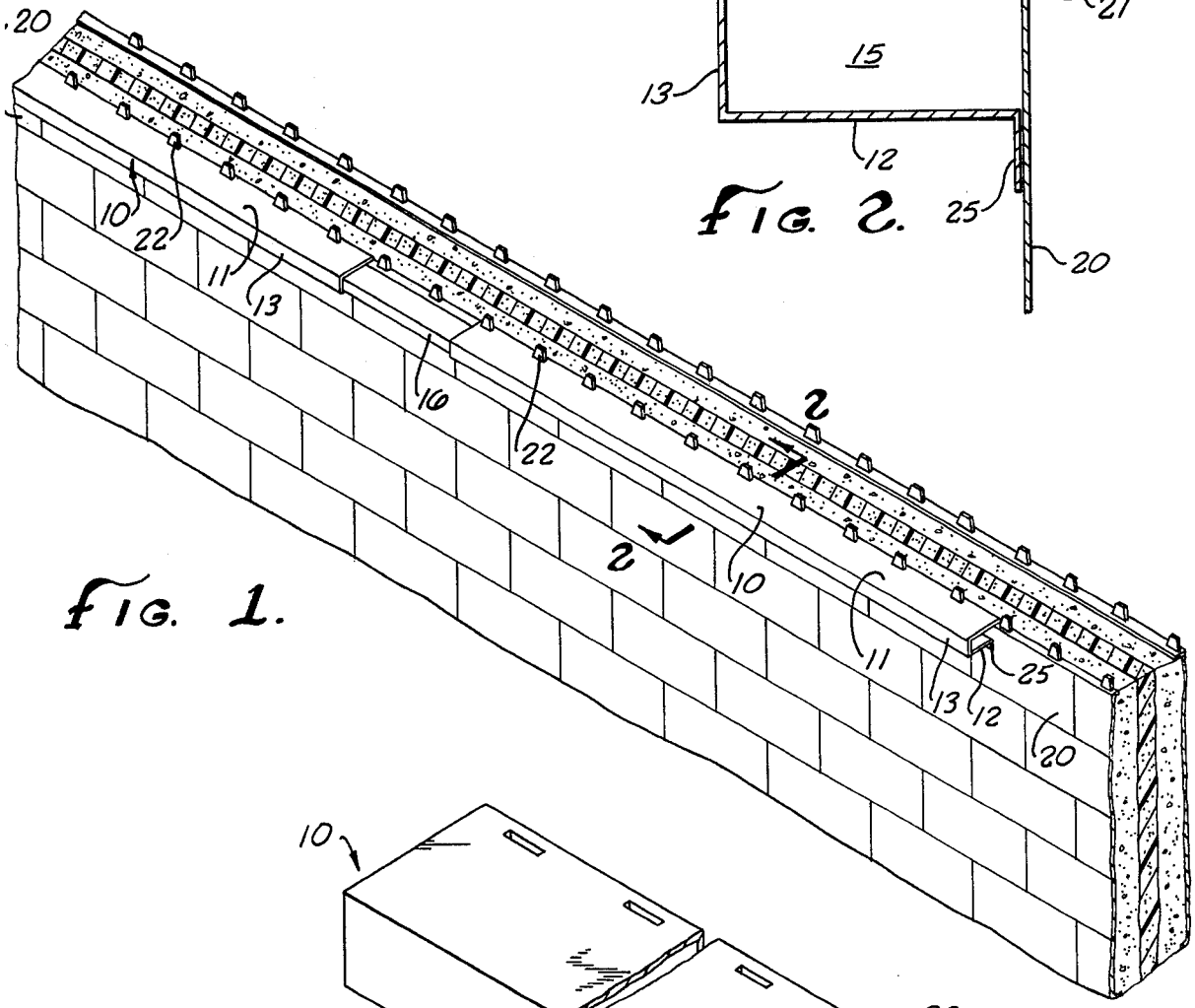
FIG. 1 is a view in perspective of a portion of a wall constructed according to the U.S. Pat. to Nilsen et al. No. 4,149,349 showing a pair of alignment struts of the present invention hung in place in one margin thereof and connected by a splice bar.
Figure 3:
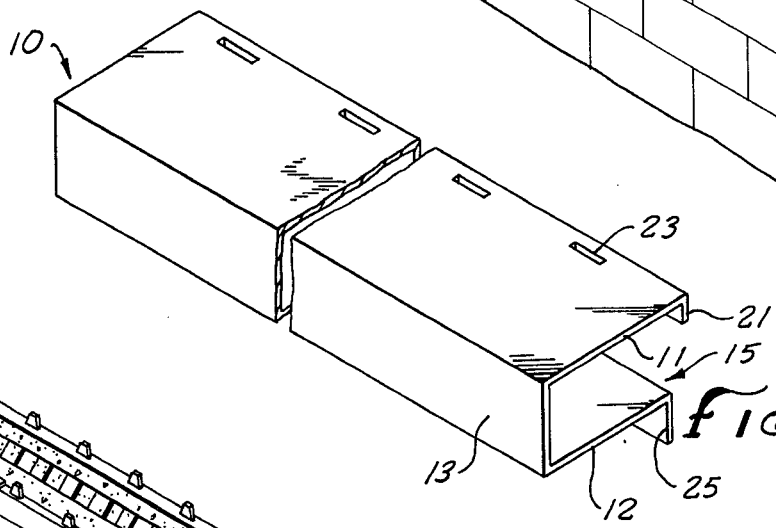
FIG. 3 is a detail view in perspective of an alignment strut embodying the present invention.
Figure 4:
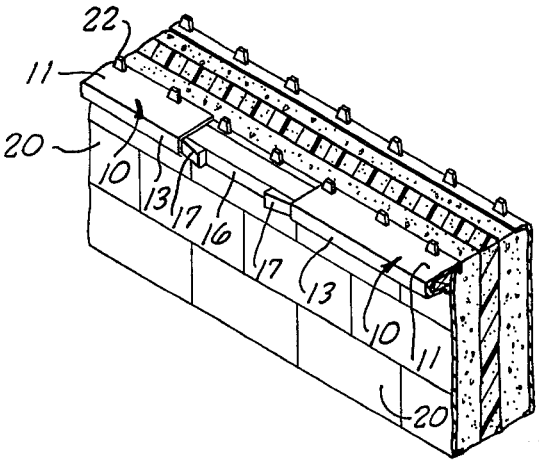
FIG. 4 is a detail view in perspective of a portion of the structure illustrated in FIG. 1 showing, additionally, the employment of wedges in conjunction with the splice bar coupling separate alignment struts embodying the present invention.

Alignment struts embodying the present invention are, as shown in FIG. 3 of the drawing, preferably made of sheet metal of sufficient rigidity to withstand deformation under ordinary conditions of use; 22 gauge galvanized steel having been found satisfactory for this purpose. The strut 10 is formed as a U-shaped beam structure having an upper leg 11 and a lower leg 12 connected by a web 13. The legs 11 and 12 define a horizontally extending open-ended pocket 15 adapted to receive a splice bar 16 (FIGS. 1 and 4). Preferably, the pocket 15 is made slightly larger in its horizontal dimension than a conventional lumber two by four, so that if desired, wedges 17 (FIG. 4) may be inserted between the web 13 and the adjacent face of the splice bar 16 to hold the latter in close engagement with one of the plates 20 forming a margin of the prefabricated wall structure.

The upper and longer leg 11 of the strut 10 is provided with a downwardly extending flange 21 at its free end for engaging the upper edge portion of one or more of the plates 20 constituting the margin of the prefabricated wall assembly and where the particular plates 20 being employed are provided with tabs 22 for the purposes described in the above mentioned U.S. patent to Nilsen et al, the upper leg 11 of each strut is provided with a series of apertures 23 positioned to interfit with the tabs 22. The lower and shorter leg 12 of the strut 10 preferably is provided with a down-turned flange 25 adapted to engage the side of one or more of the plates 20 forming a margin of the prefabricated wall assembly.

The length of the lower leg 12 is proportioned to that of the upper leg 11 so that when the alignment strut is in position on a prefabricated wall structure, as shown, the longer dimension of the pocket 15 is disposed substantially horizontally.

Figure 2:
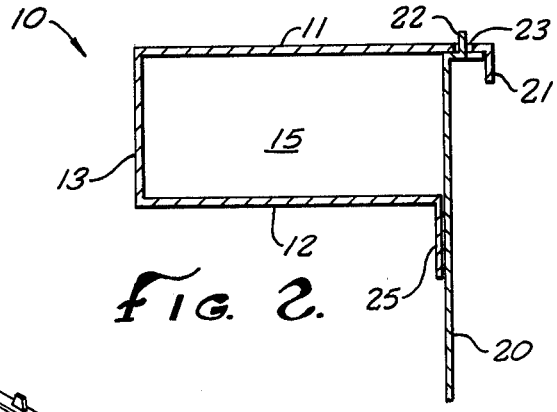
FIG. 2 is a detail view in vertical cross-section taken on the line 2—2 of FIG. 1.

In use, the alignment strut 10 of the present invention is engaged over the upper edge of one of the plates 20 forming a margin of the prefabricated wall structure with the tabs 22 of the plates 20 projecting through the apertures 23 of the strut 10 as best shown in FIG. 2. Since the alignment struts 10 are conveniently made in manipulable lengths such as approximately 8 feet, adjacent struts 10 preferably are spaced from each other as shown in FIGS. 1 and 4, and splice bars 16, preferably in the form of lumber two by fours, received in the pockets 15 of the adjacent struts 10 and, if desired, secured in position by means such as wedges 17 (FIG 4). In such an arrangement, the exposed portion of the splice bar 16 between adjacent alignment struts 10 constitutes a convenient nailing point for braces extending between the splice bar 16 and stakes driven in the ground adjacent the prefabricated wall structure or adjacent scaffolding.

I claim:

1. An alignment strut for prefabricated wall assemblies comprising a U-shaped beam structure having upper and lower legs of different lengths; the upper leg having an aperture adjacent its free end and a downwardly extending flange at its free end for engaging the upper portion of a margin of a wall assembly and the lower of said legs having a transverse portion engageable with the side of said wall assembly.

2. An alignment strut according to claim 1 in which said downwardly extending flange defines a horizontally extending open-ended pocket for reception of a splice bar wedgeable into engagement with said wall assembly and connecting adjacent struts.

3. An alignment strut according to claim 1 in which said legs define a horizontal extending open-ended pocket for reception of a splice bar connecting adjacent struts.

* * * * *